US005826567A

United States Patent [19]

Sakaguchi et al.

[11] Patent Number: 5,826,567

[45] Date of Patent: Oct. 27, 1998

[54] TWO-STROKE INTERNAL COMBUSTION ENGINE

[75] Inventors: Yukio Sakaguchi, Saitama; Noboru Nagai, Tokyo; Shigeru Sato, Saitama; Yasuharu Sato, Tokyo, all of Japan

[73] Assignee: Kioritz Corporation, Tokyo, Japan

[21] Appl. No.: 827,650

[22] Filed: Apr. 10, 1997

[30] Foreign Application Priority Data

Apr. 16, 1996 [JP] Japan ..... 8-094452

[51] Int. Cl.[6] ..... F02B 19/16

[52] U.S. Cl. ..... 123/666

[58] Field of Search ..... 123/661, 666, 123/193.5, 73 R

[56] References Cited

U.S. PATENT DOCUMENTS

| | | | |
|---|---|---|---|
| 4,538,568 | 9/1985 | Fujikawa et al. | 123/310 |
| 4,549,508 | 10/1985 | Fujimoto | 123/661 |
| 4,821,687 | 4/1989 | Iwai | 123/65 P |
| 4,825,817 | 5/1989 | Romanowski | 123/668 |
| 4,844,025 | 7/1989 | Shaeffer | 123/661 |
| 4,881,513 | 11/1989 | Hamanaka | 123/664 |
| 4,893,596 | 1/1990 | Nonaka | 123/661 |
| 5,035,210 | 7/1991 | Arai et al. | 123/193.6 |
| 5,105,795 | 4/1992 | Ozawa et al. | 123/661 |
| 5,107,810 | 4/1992 | Wu et al. | 123/661 |
| 5,163,396 | 11/1992 | Fukuda et al. | 123/661 |
| 5,211,145 | 5/1993 | Ichikawa et al. | 123/661 |
| 5,211,147 | 5/1993 | Ward | 123/661 |
| 5,323,744 | 6/1994 | Kusama et al. | 123/193.6 |
| 5,372,105 | 12/1994 | Nagao et al. | 123/193.3 |
| 5,471,960 | 12/1995 | Nagao et al. | 123/65 P |
| 5,492,092 | 2/1996 | Benson | 123/664 |

*Primary Examiner*—David A. Okonsky
*Attorney, Agent, or Firm*—Baker & Botts, L.L.P.

[57] ABSTRACT

In a two-stroke internal combustion engine, total hydrocarbon (THC) exhaust is decreased as a result of small structural changes and without loss of output power. A Schnürle scavenging-type combustion chamber has a hemispherical main surface and an annular skirt-like squish band, and a spark plug is disposed for a spark point to be substantially at the center of the combustion chamber. The squish band has minimized width.

2 Claims, 9 Drawing Sheets

1'
5'
2'
4'
10'
10a'
9a'
9'
107°
140°
BDC 1
5
2
4
10
10a
9a
9
94°
110°
BDC

TWO-STROKE INTERNAL COMBUSTION ENGINE

BACKGROUND OF THE INVENTION

1. Field of the Invention

The present invention relates to a small air-cooled two-stroke gasoline engine having a displacement of about 15 cc to about 35 cc which is preferably used in a small-sized hand-held working machine such as a brush cutter or chain saw. More particularly, it relates to a small air-cooled two-stroke gasoline engine which is designed so as to reduce noxious pollutants in an exhaust gas, in particular, total HC (THC) without impairing output power characteristics.

2. Description of the Prior Art

Recently, due to increased environmental awareness, even with respect to a small air-cooled two-stroke gasoline engine which is used in a hand-held working machine such as a brush cutter or chain saw, it has been strongly desired to render an exhaust gas discharged therefrom less pollutive by reducing noxious pollutants such as HC, CO and NOx in the exhaust gas. For example, according to the regulation of exhaust gas bill in the State of California, i.e., so-called CARB 1999, it is required to reduce CO, total HC (THC) and NOx contents of an exhaust gas to not higher than 130 g/bhp-h, 50 g/bhp-h and 4 g/bhp-h, respectively, from 1999 onward.

FIGS. 8 and 9 show an example of a conventional small air-cooled two-stroke gasoline engine which has been exposed to a demand for reduction of noxious pollutants contained in an exhaust gas.

The illustrated internal combustion engine 1' is a Schn ürle scavenging type small air-cooled two-stroke gasoline engine which is incorporated as a power source into a hand-held working machine such as a brush cutter or chain saw and whose displacement is about 23 cc. The internal combustion engine 1' comprises a cylinder 2' having a combustion chamber 5' equipped with a spark plug 15, a crank case 3 connected to the bottom of the cylinder 2', and a piston 4' fit-inserted in the cylinder 2'. In the cylinder 2', an intake port 7 connected to a carburetor (not shown) and an exhaust port 10' are formed so as to open oppositely at different levels, and a pair of scavenging ports 9' 9' are formed symmetrically with respect to the longitudinal sectional plane bisecting the exhaust port 10' and the intake port 7. Opening and closing of these ports 10', 7 and 9', 9' are effected by the reciprocating movement of the piston 4'.

As in a customary internal combustion engine, reciprocating motion of the piston 4' is converted into rotational motion of a crank shaft 12, on which a balance weight 14 is mounted, via a connecting rod 11, and the output power from the crank shaft 12 is utilized as a driving force of the hand-held working machine.

In the internal combustion engine 1', during a reciprocation, i.e., two strokes of the piston 4', steps of compression, combustion, intake, scavenging, expansion and exhaust are effected in a well-known manner as a consequence of the vertical reciprocation of the piston 4'. In the conventional engine 1', for example, as shown in the conceptional diagram of FIG. 6(B), opening and closing of the exhaust port 10' and the scavenging ports 9', 9' by means of the piston 4' are timed, in view mainly of output power characteristics, that the exhaust port 10' and the scavenging ports 9', 9' are open when the crank shaft 12 is within ranges covering an angle of 140 degrees and an angle of 107 degrees in terms of its crank angle, respectively, each of which centrally contains the bottom dead center (BDC). In other words, the exhaust port 10' and the scavenging ports 9', 9' are closed when the crank shaft 12 is outside the above respective ranges in terms of its crank angle.

As shown in FIG. 5(B) which is an enlarged view of the combustion chamber 5' and its surroundings, the combustion chamber 5' is a squish dome type combustion chamber which comprises a substantially conical or hoof-shaped main surface 5*a'* and an annual skirt-like squish band 5*b'* gently sloping and having a relatively large band width $\alpha'$ (maximum width: 8 mm, minimum width: 3 mm). The combustion chamber 5' is equipped with a spark plug 15' in the conical surface opposite to the exhaust port 10' in such a manner that a spark point SP' of the sparking plug 15' is located nearer to the exhaust port 10' than the center line C of the combustion chamber 5'.

Further, as shown in FIG. 5(B), a distance L' between the top surface 4*a'* of the piston 4' and the upper edge 4*b'* of a groove for retaining the upper piston ring 21' of piston rings is about 2.5 mm, and each of the piston rings 21', 22' has a thickness d' of about 2.0 mm.

In the conventional small air-cooled two-stroke gasoline engine 1' as described above which is used in a hand-held working machine, relatively large gaps are formed in a circumferential portion of the bottom of the combustion chamber 5', in particular, a gallery gap D' defined between the squish band 5*b'* and the piston 4' at top dead center (TDC), and a gap E' defined by the piston 4' at top dead center (TDC), the inner circumferential wall of the cylinder 2', and the upper piston ring 21'. An unburnt gas mixture therein is unlikely to be exposed to flame, thereby causing an increase of THC content of an exhaust gas.

SUMMARY OF THE INVENTION

The present invention has been made in view of these problems. It is, therefore, an object of the present invention to provide a two-stroke internal combustion engine with a reduced amount of unburnt gas mixture in a circumferential portion at the bottom of the combustion chamber where it is unlikely to be exposed to flame, to effectively reduce THC content without lowering of output power characteristics or any considerable structural change.

To attain the above object, in a two-stroke internal combustion engine of a Schnürle scavenging type which is provided with a squish dome type combustion chamber, the present invention is directed to improvement of a circumferential portion of the bottom of the combustion chamber. The combustion chamber comprises a hemispherical main surface and an annular skirt-like squish band and is equipped with a spark plug in such a manner that a spark point of the spark plug is located substantially at the center of the combustion chamber, and the squish band has a minimized band width.

By virtue of the hemispherical configuration of the main surface of the combustion chamber and the location of the spark point (center electrode) of the spark plug substantially at the center of the combustion chamber as described above, an ideal mode of combustion is attained such that flame propagates substantially simultaneously throughout the combustion chamber. Consequently, increased explosion pressure is attained and thus output power is raised.

Further, the minimized band width can reduced the amount of unburnt gas mixture which is unlikely to be exposed to flame. As a result, THC content of an exhaust gas is reduced. The conventional squish band strongly urges a gas mixture toward a center portion of the combustion chamber and thus effects an increase of combustion velocity. However, such a squish band has a large S/V value (surface area/volume ratio of a combustion chamber) and is thus highly susceptible to heat loss. This increases the amount of unburnt gas mixture in an exhaust gas.

On the other hand, in the internal combustion engine according to the present invention whose displacement is in a range of 15 cc to 35 cc, it is preferred that a distance L between a top surface of a piston and an upper edge of a groove for retaining an upper piston ring of piston rings be 2.0 mm or less, and each of the piston rings have a thickness d of 1.5 mm or less.

In the conventional engine 1' of this type, the distance L' between the top surface 4*a*' of the piston 4' and the upper edge 4*b*' of a groove for retaining the upper piston ring 21' is about 2.5 mm, and the piston ring 21' has a thickness d' of about 2.0 mm. In contrast thereto, in the present invention, the distance L is reduced to 2.0 mm or less, thereby to reduce volume of the gap (defined by the circumferential inner wall of the cylinder, the circumferential side surface of the piston at the top dead center (TDC) and the upper ring) in which an unburnt gas mixture is collected. Accordingly, THC content of an exhaust gas is reduced. Further, the thickness d of the piston ring 21 is reduced to 1.5 mm or less, so that frictional loss due to friction between the piston ring and the inner wall of the cylinder is reduced. In consequence, output power is raised.

DESCRIPTION OF THE PREFERRED EMBODIMENT

Figure 1:
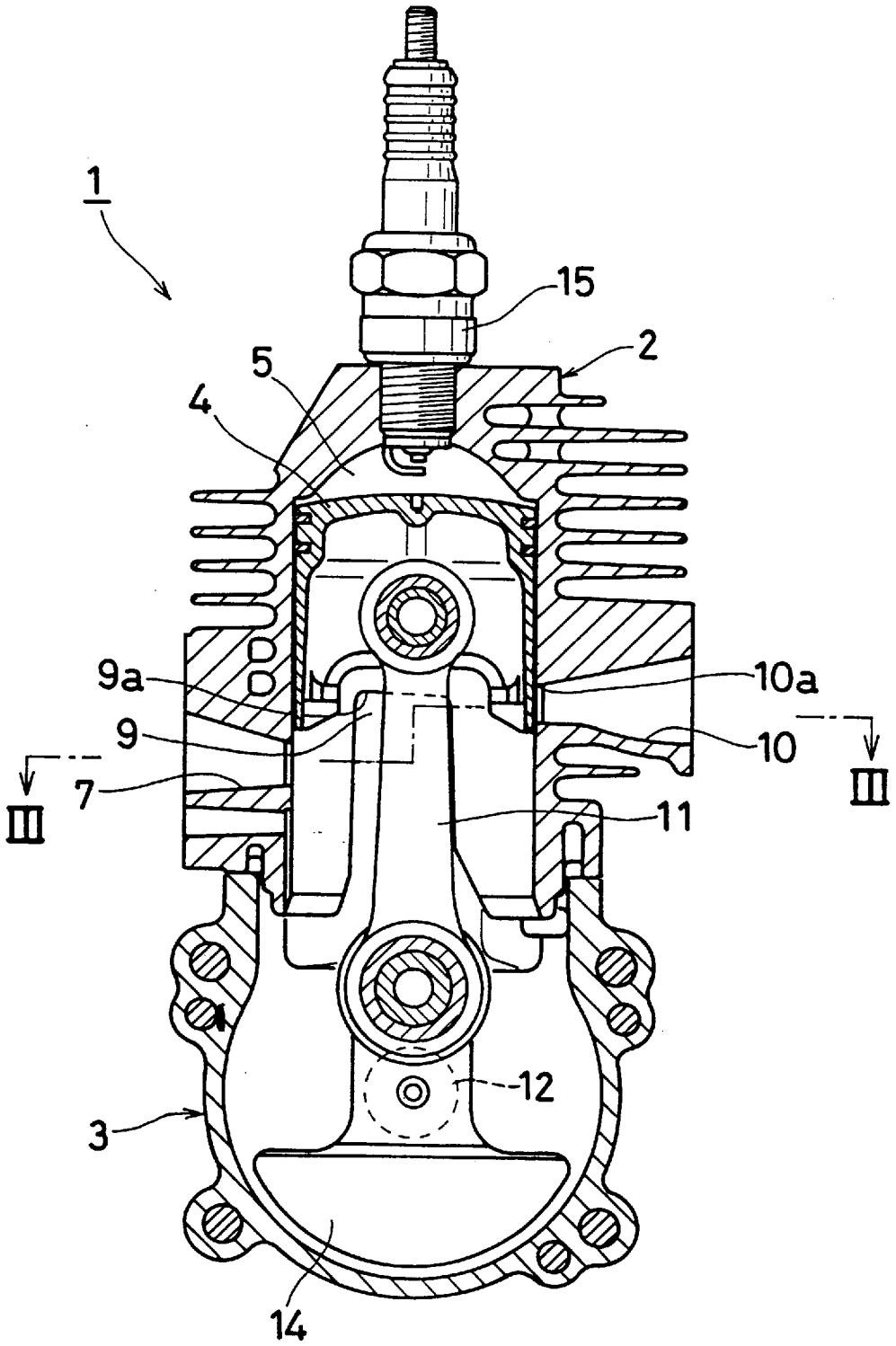
FIG. 1 is a bisectional view of an embodiment of the two-stroke internal combustion engine according to the present invention, which is taken across a crank shaft.
Figure 2:
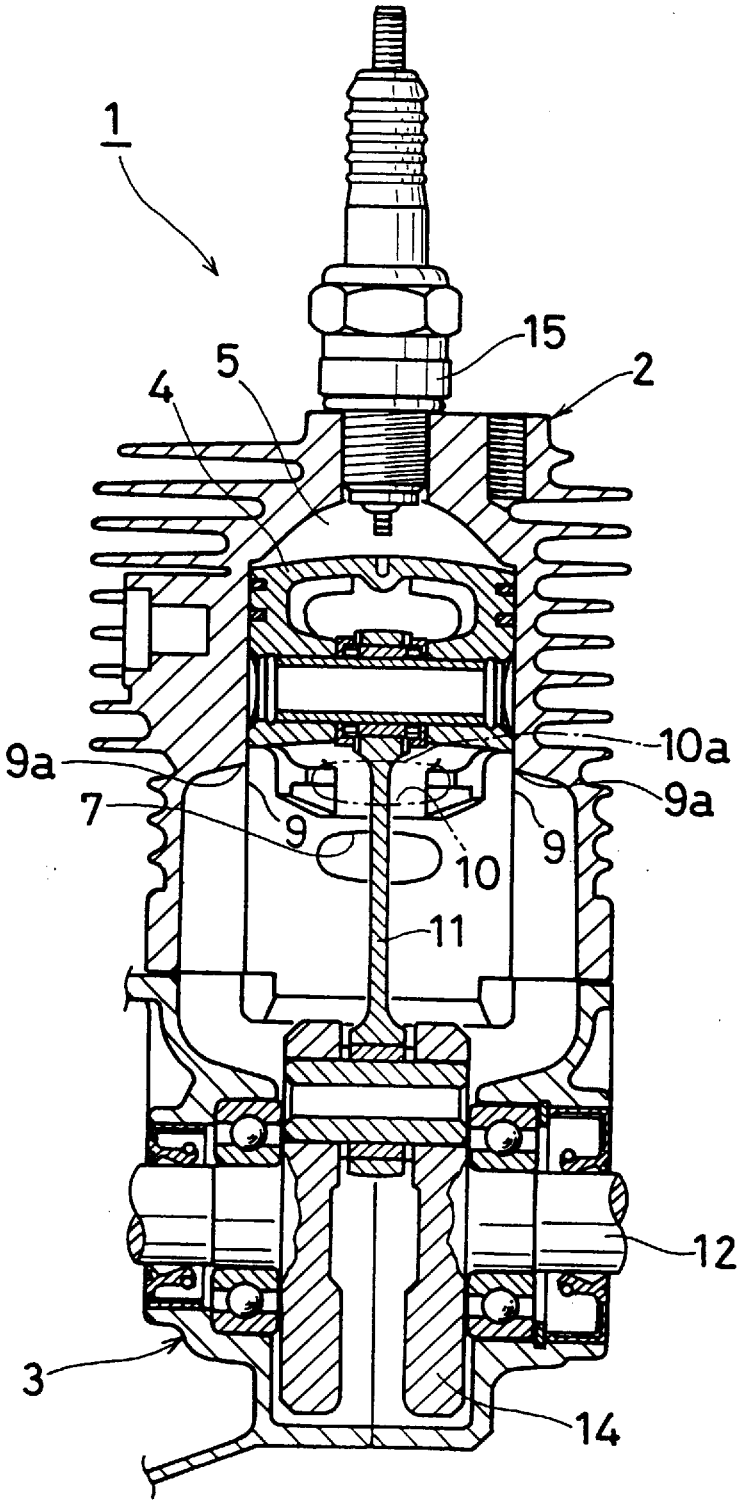
FIG. 2 is a bisectional view of the embodiment of the two-stroke internal combustion engine shown in FIG. 1, which is taken along the crank shaft.

In the following, an embodiment of the present invention will be described with reference to the accompanying drawings. FIGS. 1 and 2 show a small air-cooled two-stroke gasoline engine (hereinafter referred to simply as internal combustion engine) as an embodiment according to the present invention. The illustrated internal combustion engine 1 is a Schnürle scavenging type internal combustion engine which is incorporated as a power source into a hand-held working machine such as a brush cutter or chain saw and whose displacement is about 23 cc.

Figure 3:
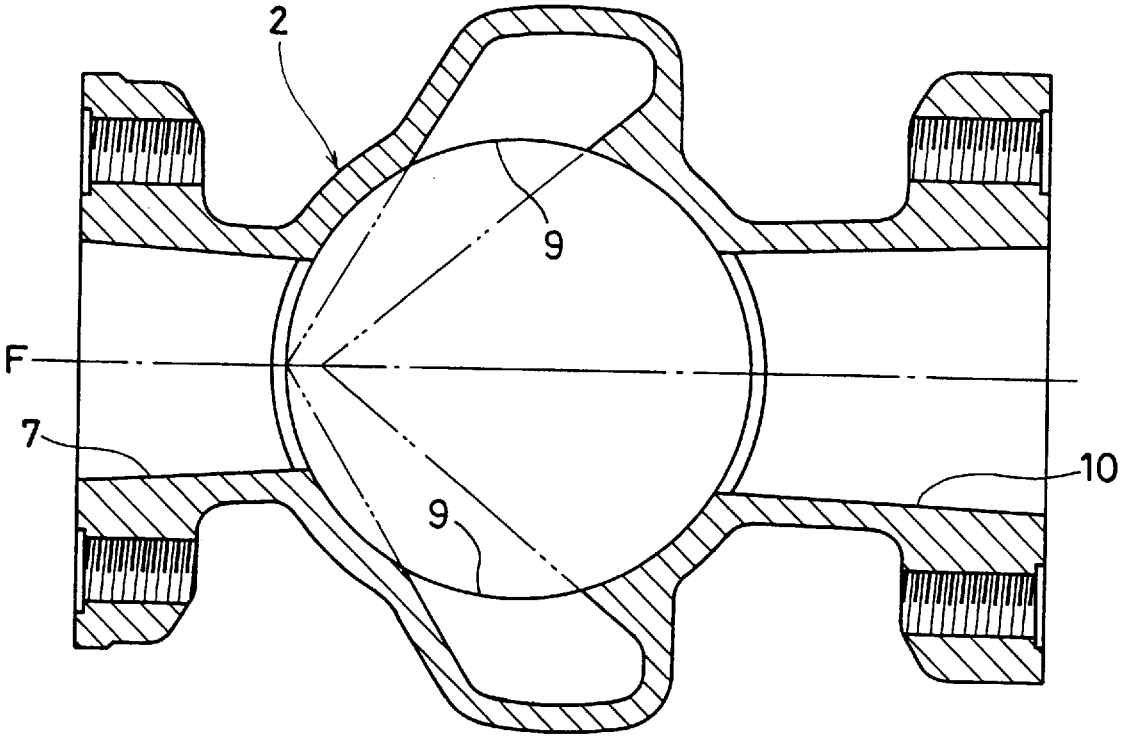
FIG. 3 is a sectional view taken along the line III—III and viewed in the direction of the arrows in FIG. 1.

As in the above-described conventional internal combustion engine 1', the internal combustion engine 1 according to the present invention comprises a cylinder 2 having a combustion chamber 5 equipped with a spark plug 15, a crank case 3 connected to the bottom of the cylinder 2, and a piston 4 fit-inserted in the cylinder 2. In the cylinder 2, an intake port 7 connected to a carburetor (not shown) and an exhaust port 10 are formed so as to open oppositely at different levels, and as shown in FIG. 3, a pair of scavenging ports 9, 9 are formed symmetrically with respect to the longitudinal sectional plane F bisecting the exhaust port 10 and the intake port 7. Opening and closing of these ports 10, 7, and 9, 9 are effected by the reciprocating movement of the piston 4.

Further, as in the conventional internal combustion engine 1', reciprocating motion of the piston 4 is converted into rotational motion of a crank shaft 12, on which a balance weight 14 is mounted, via a connecting rod 11, and the output power form the crank shaft 12 is utilized as a driving force of the hand-held working machine.

Figure 6:
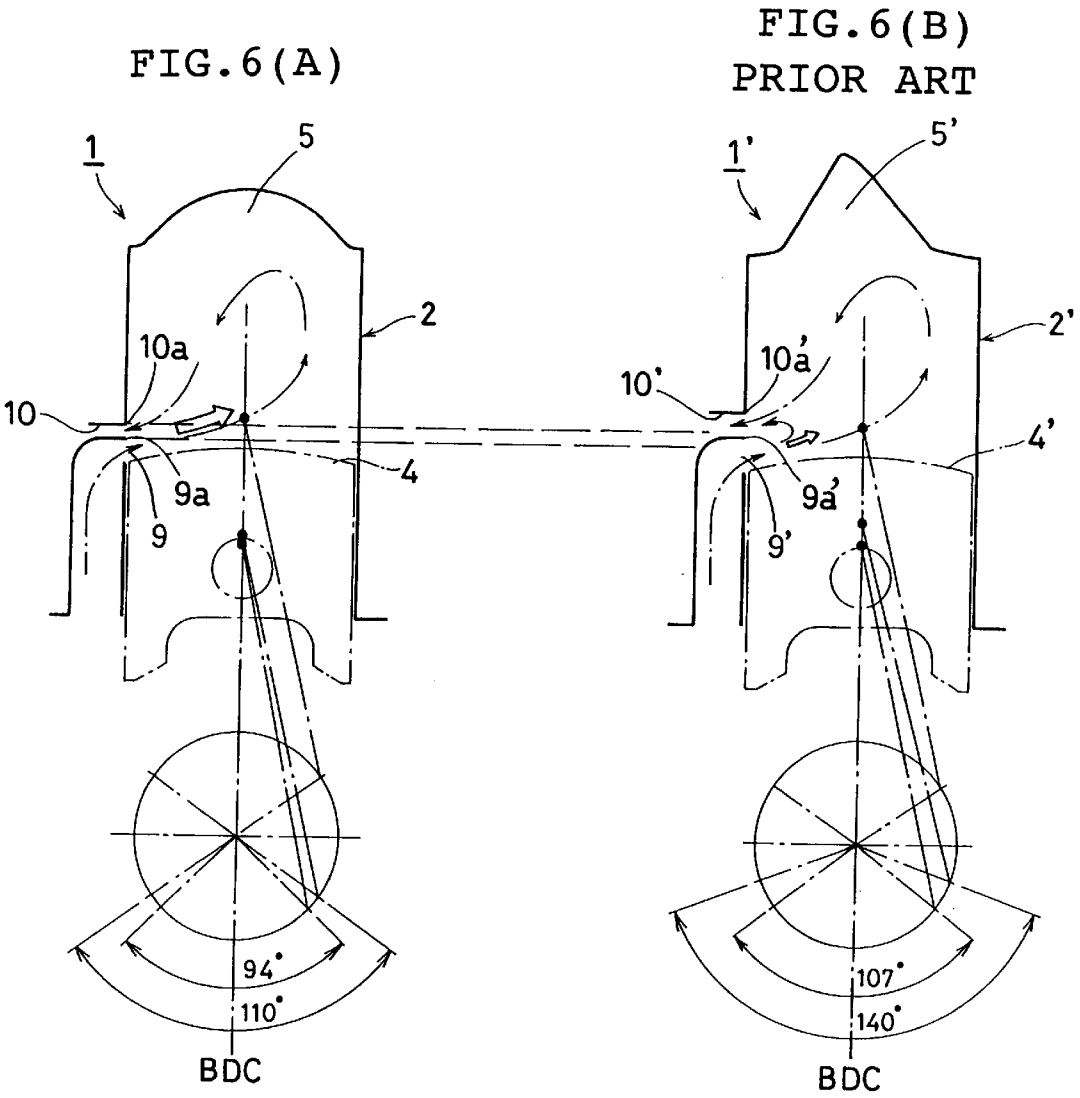
FIG. 6 (B) PRIOR ART
FIG. 6(A) is a diagrammatic view illustrating timing of opening and closing of an exhaust port and scavenging ports of the embodiment of the internal combustion engine according to the present invention shown in FIG. 1. (For convenience of explanation, the scavenging port is shown as being positionally shifted in the horizontal direction in an angular amount of 90 degrees. The same is true of FIG. 6(B))
FIG. 6(B) is a diagrammatic view illustrating timing of opening and closing of an exhaust port and scavenging ports of the conventional internal combustion engine shown in FIG. 8.

In the internal combustion engine 1, during a reciprocation, i.e., two strokes of the piston 4, steps of compression, combustion, intake, scavenging, expansion and exhaust are effected in a well-known manner as a consequence of the vertical reciprocation of the piston 4. In the internal combustion engine 1, as shown in the conceptional diagram of FIG. 6(A), opening and closing of the exhaust port 10 and the scavenging ports 9, 9 by means of the piston 4 are timed such that the exhaust port 10 and the scavenging ports 9, 9 are open when the crank shaft 12 is within ranges covering an angle of 110 degrees and an angle of 94 degrees in terms of its crank angle, respectively, each of which centrally contains the bottom dead center (BDC). In other words, the exhaust port 10 and the scavenging ports 9, 9 are closed when the crank shaft 12 is outside the above respective ranges in terms of its crank angle.

Figure 4:
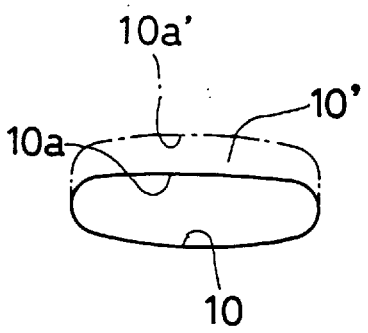
FIG. 4 is an illustrative view comparatively showing an exhaust port of the embodiment of the two-stroke internal combustion engine according to the present invention shown in FIG. 1 and that of the conventional internal combustion engine shown in FIG. 8.

In this embodiment, the opening and closing of the exhaust port 10 and the scavenging ports 9, 9 with such timing are attained by virtue of the lowered positions of the upper ends 10*a* and 9*a*, 9*a* of the exhaust port 10 and the scavenging ports 9, 9, and the reduced distance between the upper end 10*a* of the exhaust port 10 and the upper end 9*a* of each of the scavenging ports 9, 9 in the vertical direction. In this connection, FIG. 4 shows superimposition of the exhaust port 10 (shown by solid line) of this embodiment and the exhaust port 10' (shown in phantom) of the conventional engine. As shown, the position of the upper end 10*a* of the exhaust port 10 of this embodiment is considerably lower than that of the upper end 10*a'* of the conventional exhaust port 10'.

In the conventional internal combustion engine 1', the opening and closing of the exhaust port 10' and the scavenging ports 9', 9' are timed such that the exhaust port 10' and the scavenging ports 9', 9' are open when the crank shaft 12 is within the ranges covering an angle of 140 degrees and an angle of 107 degrees in terms of its crank angle, respectively, as described above, whereas in this embodiment, the respective ranges respectively cover an angle of 110 degrees and an angle of 94 degrees as described above. Accordingly, the exhaust port 10 and the scavenging ports 9, 9 are opened later in a descending stroke of the piston 4 and closed earlier in an ascending stroke of the piston 4 as compared with those in the conventional internal combustion engine 1'.

Consequently, explosion energy is sufficiently converted into force urging the piston 4 downward until exhaust initiation when the exhaust port 10 commences to open. This results in lowered exhaust gas pressure. Accordingly, scavenging gas flow does not yield to back pressure, and thus flow velocity of the scavenging gas flow is greatly increased as compared with the conventional engine 1', as shown by contoured arrows in FIGS. 6(A) and 6(B). In consequence, effective scavenging is attained.

Figure 7:
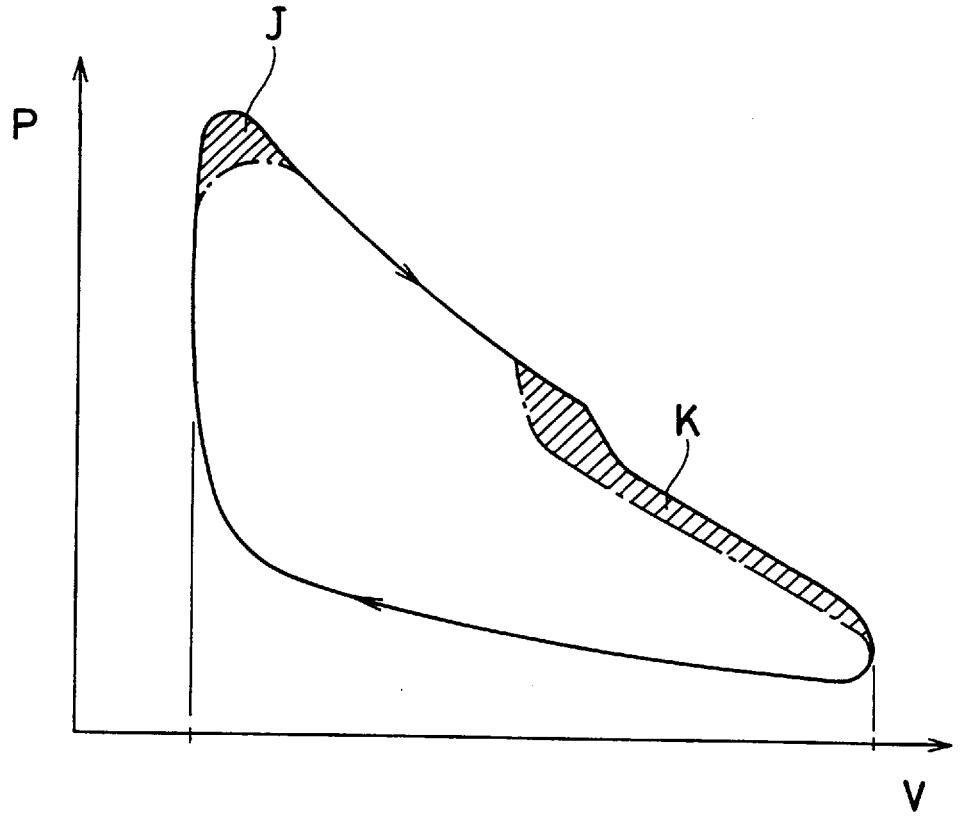
FIG. 7 is a diagrammatic representation illustrating output characteristics of the embodiment of the internal combustion engine according to the present invention shown in FIG. 1 and the conventional internal combustion engine shown in FIG. 8.
Figure 8:
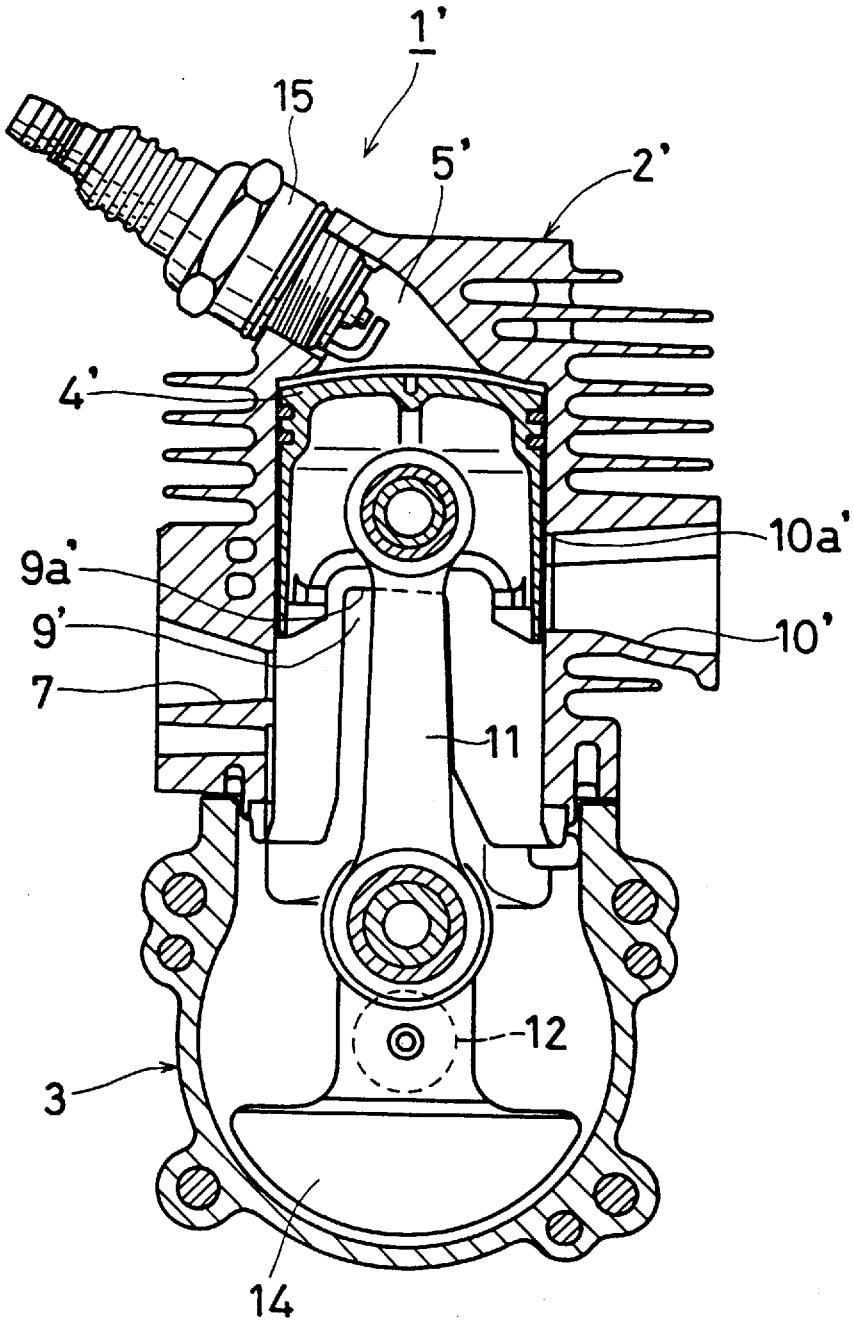
FIG. 8 PRIOR ART
FIG. 8 is a bisectional view of one form of a conventional two-stroke internal combustion engine, which is taken across a crank shaft
Figure 9:
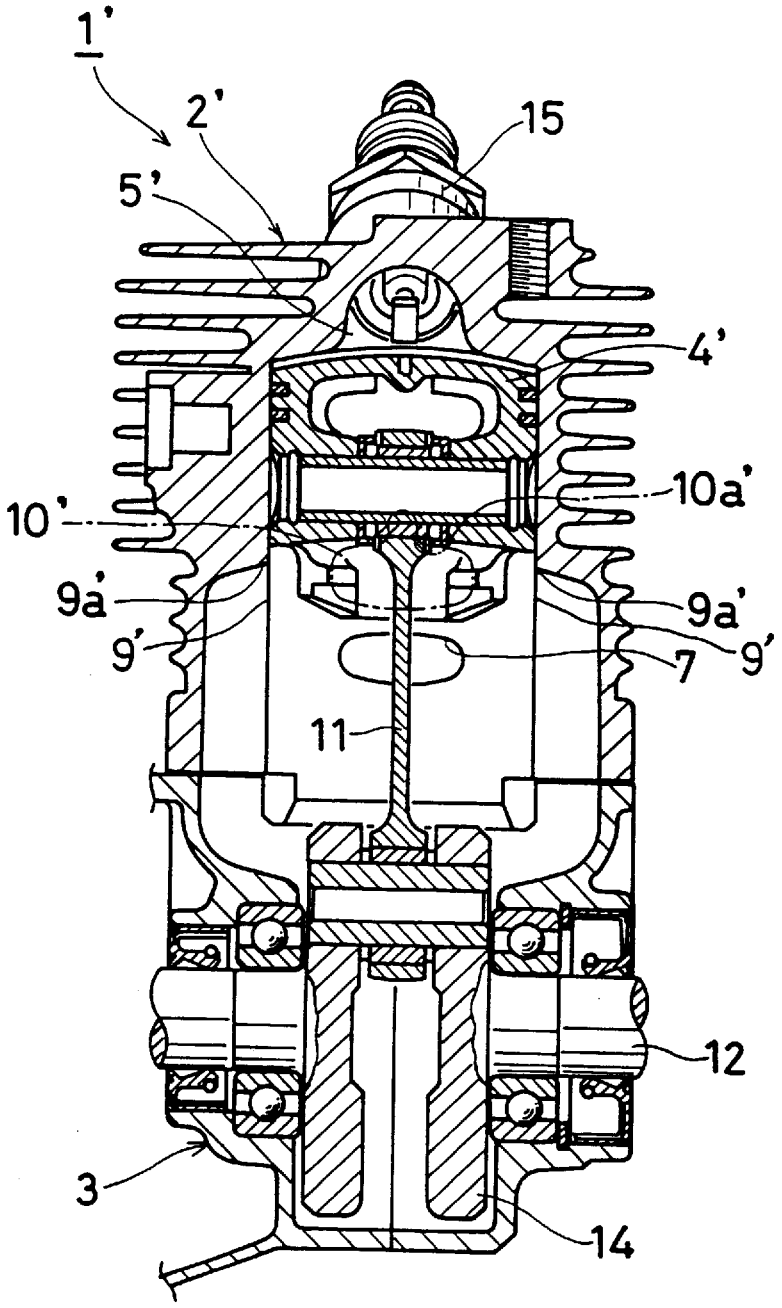
FIG. 9 PRIOR ART
FIG. 9 is a bisectional view of the one form of the conventional two-stroke internal combustion engine shown in FIG. 8, which is taken along the crank shaft.

Such effective scavenging results in reduced "blow through" amount and reduced THC content of an exhaust gas, and leads to raised output power. FIG. 7 shows a PV diagram (Pressure-Volume diagram) for the engine 1 of this embodiment (shown by a solid line) and a PV diagram for the conventional engine 1' (shown in phantom), showing that output power of the engine 1 of this embodiment is raised with an increment corresponding to the hatched area K in FIG. 7 as compared with the conventional engine 1'. This is due to the narrowed ranges covering an angle of 110 degrees and an angle of 94 degrees for respectively opening the exhaust port 10 and the scavenging ports 9, 9.

These effects are attained just by changing the shapes and positions of the exhaust port 10 and scavenging ports 9, 9. This does not lead to increased cost.

Figure 5A:
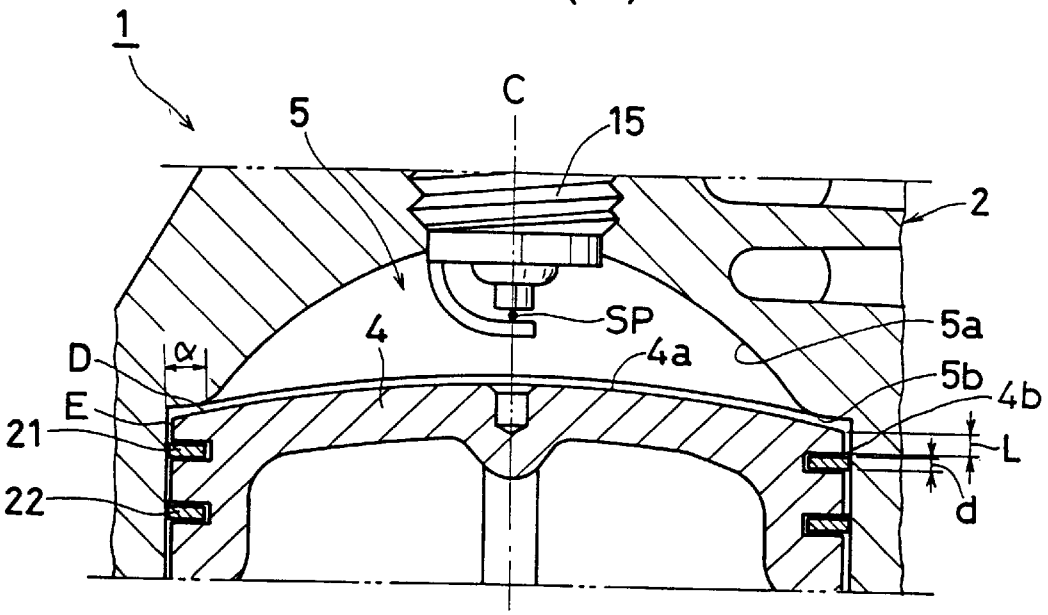
FIG. 5(A) is an enlarged view showing a combustion chamber and its vicinity of the embodiment of the internal combustion engine according to the present invention shown in FIG. 1.
Figure 5B:
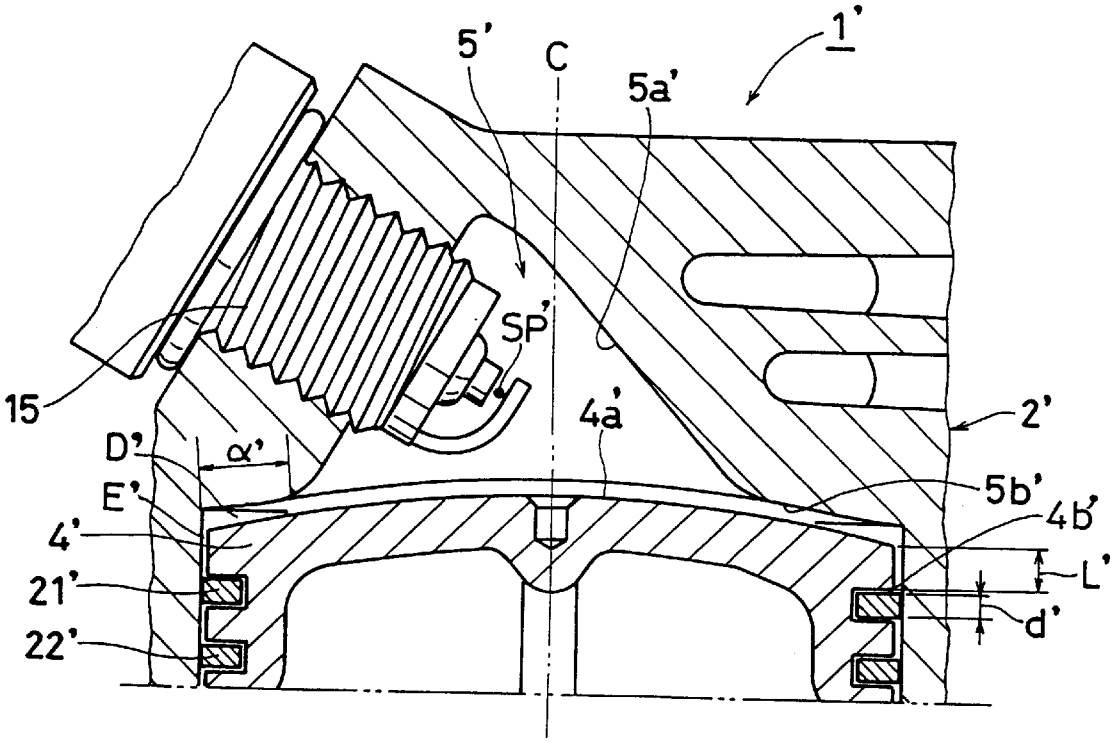
FIG.5(B) PRIOR ART
FIG. 5(B) is an enlarged view showing a combustion chamber and its vicinity of the conventional internal combustion engine shown in FIG. 8.

As shown in FIG. 5(A) which is an enlarged view of the combustion chamber 5 and its vicinity, the combustion chamber 5 is a squish dome type combustion chamber which comprises a bell-bottomed hemispherical main surface 5*a* concentric with the cylinder 2 and an annual skirt-like squish band 5*b* gently sloping and having a band width $\alpha$ (2 mm) considerably smaller than the band width $\alpha'$ of the conventional squish band 5*b'*. A spark plug 15 is mounted upright on the combustion chamber 5 along the center line C of the combustion chamber 5, so that a spark point SP (center electrode) of the spark plug 15 is located substantially at the center of the combustion chamber 5.

By virtue of the hemispherical configuration of the main surface 5*a* of the combustion chamber 5 and the location of the sparking point SP of the sparking plug 15 substantially at the center of the main surface 5*a* of the combustion chamber 5 as described above, an ideal mode of combustion is attained such that a flame propagates substantially simultaneously throughout the combustion chamber 5. Consequently, increased explosion pressure is attained and thus output power is raised. Specifically, output power of the engine 1 of this embodiment is raised with an increment corresponding to the hatched area J in the superimposed PV diagrams in FIG. 7 as compared with that of the conventional engine 1'.

Further, since the band width $\alpha$ of the squish band 5*b* is considerably smaller than that the band width $\alpha'$ in the conventional internal combustion engine 1', a gallery gap D defined between the squish band 5*b* and the piston 4 at the top dead center (TDC) is considerably smaller than that a gallery gap D' in the conventional internal combustion engine 1'. Accordingly, any amount of an unburnt gas mixture in a place to which flame propagation is impeded is small. In consequence, THC content of an exhaust gas is reduced.

Moreover, in this embodiment, a distance L between a top surface 4*a* of the piston 4 and an upper edge 4*b* of a groove for retaining an upper piston ring 21 is as small as about 1.5 mm, and each of the piston rings 21, 22 has a thickness d as small as about 1.2 mm.

In contrast thereto, in the conventional engine 1', a distance L' between a top surface 4*a'* of the piston 4' and an upper edge 4*b'* of a groove for retaining an upper piston ring 21' is about 2.5 mm, and each of the piston rings has a thickness d' of about 2.0 mm.

By reducing the distance L to 2.0 mm or smaller as in this embodiment, a gap E (where an unburnt gas mixture is collected) is reduced. The gap E is defined by the inner wall surface of the cylinder 2, the circumferential side surface of the piston 4 at the top dead center (TDC) and the upper piston ring 21 as shown in FIG. 5(A). Accordingly, THC content of an exhaust gas is reduced. By reducing the thickness d of each of the piston rings 21, 22 to 1.5 mm or smaller, frictional loss due to friction between each of the piston rings 21, 22 and the inner surface of the cylinder 2 is reduced. In consequence, output power is raised.

Furthermore, the hemispherical combustion chamber 5 and the reduced band width $\alpha$ of the squish band 5*b* can provide for minimized burning gas contact area, thereby controlling heat loss to facilitate complete combustion.

To demonstrate the above-described effects, comparative experiments were conducted using the internal combustion engine 1 according to this embodiment of the present invention and the conventional internal combustion engine 1' under the same conditions. The results of the experiments are shown in FIG. 10.

Figure 10:
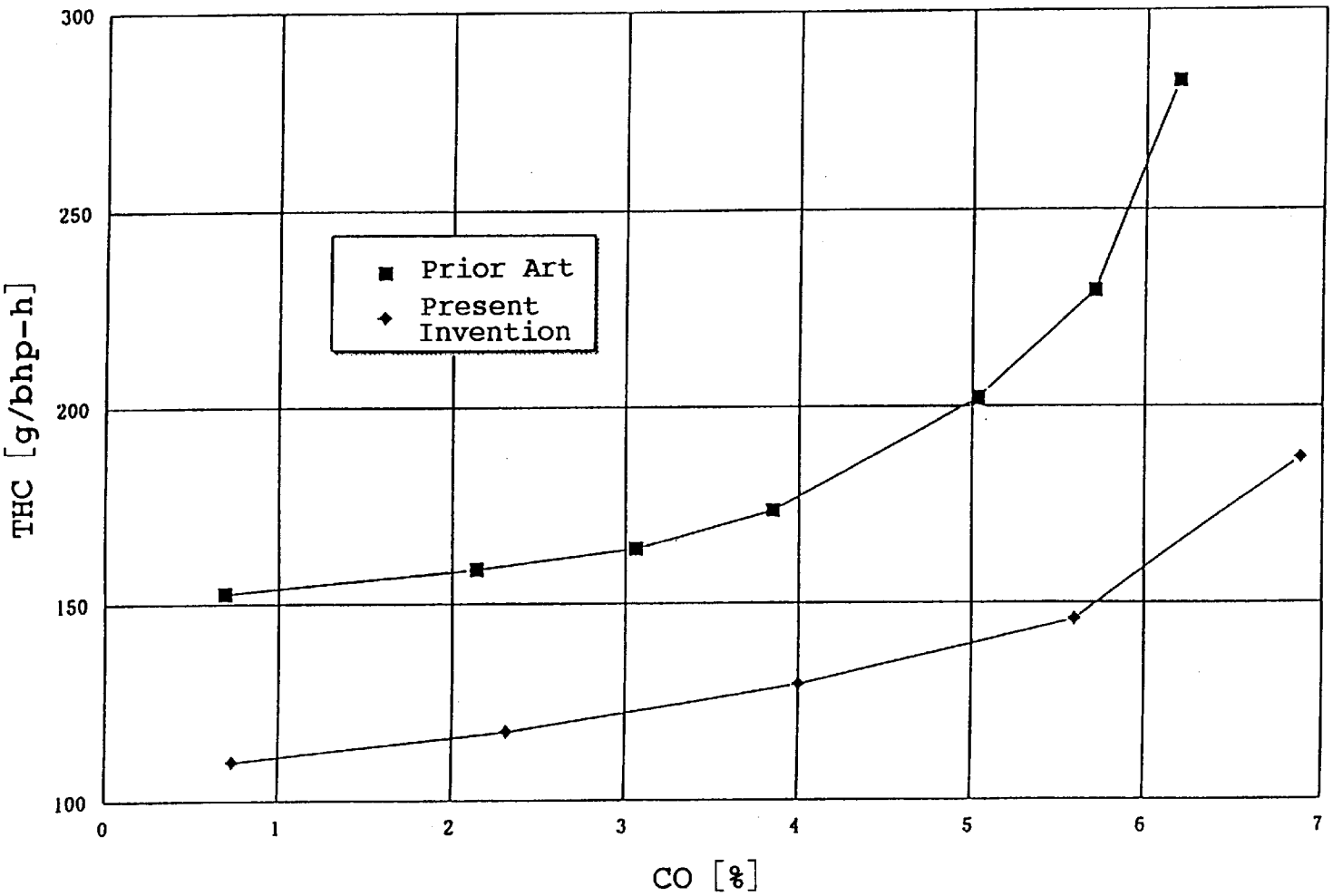
FIG. 10 is a graph showing results of comparative experiments on exhaust pollutant reducing characteristics of the embodiment of the two-stroke internal combustion engine according to the present invention shown in FIG. 1 and the conventional internal combustion engine shown in FIG. 8.

FIG. 10 shows that THC in the exhaust gas is greatly reduced in the internal combustion engine 1 according to this embodiment of the present invention as compared with the conventional engine 1'.

In the foregoing, one embodiment of the present invention has been described in detail. It is, however, to be understood that the present invention is by no means restricted to the above-described embodiment and that various modifications may be made within the scope which does not depart from the spirit of the present invention as defined in the claims.

For example, it is desired that opening and closing of the exhaust port and of the scavenging ports by means of the piston be timed such that the exhaust port and the scavenging ports are open when the crank shaft is within ranges covering an angle of 100–120 degrees and an angle of 85–100 degrees in terms of its crank angle, respectively, each of which centrally contains the bottom dead center (BDC). However, the ranges may be those covering angles not exceeding 130 degrees and 110 degrees to attain satisfactory effects, respectively.

As understood from the above description, according to the two-stroke engine of the present invention, excellent effects are obtained without involving any considerable structural change, in that output power is increased and THC in an exhaust gas is effectively reduced.

What is claimed is:

1. A two-stroke internal combustion engine comprising:

a cylinder having a squish-dome-type combustion chamber comprising a bell-bottom hemispherical main surface and an annular skirt-like squish band whose width is less than or equal to 7% of cylinder diameter, for minimized THC exhaust from the engine;

a spark plug disposed for igniting a combustible mixture in the combustion chamber, having a spark point which is located substantially centrally in the combustion chamber; and a piston slidably disposed in the cylinder, having a plurality of piston rings retained in grooves in the piston.

2. The two-stroke internal combustion engine according to claim 1, having a displacement in a range from 15 cc to 35 cc, and wherein a top surface of the piston and an upper edge of the groove retaining the piston ring closest to the top surface are apart by not more than 2.0 mm, and each piston ring has a thickness which does not exceed 1.5 mm.

* * * * *